US008137165B2

(12) United States Patent
Loveless et al.

(10) Patent No.: US 8,137,165 B2
(45) Date of Patent: Mar. 20, 2012

(54) DUST SHROUD WITH ADJUSTABLE MOUNTING MECHANISM

(75) Inventors: Michael Loveless, Price, UT (US); Spencer Loveless, Price, UT (US)

(73) Assignee: Dust Collection Products, LLC, Price, UT (US)

( * ) Notice: Subject to any disclaimer, the term of this patent is extended or adjusted under 35 U.S.C. 154(b) by 561 days.

(21) Appl. No.: 12/353,191

(22) Filed: Jan. 13, 2009

(65) Prior Publication Data

US 2009/0181605 A1 Jul. 16, 2009

Related U.S. Application Data

(60) Provisional application No. 61/021,322, filed on Jan. 15, 2008.

(51) Int. Cl.
*B24B 55/06* (2006.01)

(52) U.S. Cl. ..... 451/456; 451/451; 451/453; 451/454; 451/455

(58) Field of Classification Search ..... 451/453, 451/360, 454, 455, 456, 353, 357; 83/100; 30/124, 156; 144/252.1, 252.2
See application file for complete search history.

(56) References Cited

U.S. PATENT DOCUMENTS 907,734 A * 12/1908 Butterfield ..... 144/251.2
1,123,562 A * 1/1915 Lund ..... 451/454
RE15,262 E 1/1922 Gurgel
1,643,882 A 9/1927 Faiver
2,032,382 A * 3/1936 Torrison ..... 451/357
2,041,689 A 5/1936 Baumeister et al.
2,291,269 A 7/1942 Wiggleworth
2,478,074 A 8/1949 Atkin
2,503,854 A 4/1950 Trainor
2,520,725 A 8/1950 Judd
2,803,098 A 8/1957 Robert et al.
2,819,570 A * 1/1958 Tocci-Guilbert et al. ..... 451/451
2,819,571 A 1/1958 Morgan
2,994,995 A 8/1961 Griffith
3,166,877 A 1/1965 Reames
3,468,076 A 9/1969 Jones
3,667,170 A 6/1972 MacKay
3,673,744 A 7/1972 Oimoen
3,835,543 A 9/1974 Polydoris et al.
3,848,686 A 11/1974 Jysky et al.
3,862,521 A 1/1975 Isaksson
3,882,598 A 5/1975 Earle et al.
3,882,644 A 5/1975 Cusumano
4,002,182 A 1/1977 Michel
4,063,478 A 12/1977 Stuy
4,090,297 A 5/1978 Wanner et al.
4,135,334 A 1/1979 Rudiger
4,253,362 A 3/1981 Olson (Continued)

FOREIGN PATENT DOCUMENTS

EP 556713 8/1993

(Continued)

*Primary Examiner* — George Nguyen
(74) *Attorney, Agent, or Firm* — Bateman IP; Randall B Bateman; Brett Peterson

(57) ABSTRACT

A universal dust shroud includes mounting brackets held above the shroud body by springs. The brackets move radially and vertically relative to the body to accommodate different angle grinders, and allow vertical movement of the shroud body relative to the grinding disk while using the grinder to allow the user greater control over the angle grinder.

19 Claims, 5 Drawing Sheets

U.S. PATENT DOCUMENTS

| | | | | | |
|---|---|---|---|---|---|
| 4,381,628 | A | | 5/1983 | Dicke | |
| 4,400,995 | A | | 8/1983 | Palm | |
| 4,574,532 | A | | 3/1986 | Haberle et al. | |
| 4,576,072 | A | | 3/1986 | Terpstra et al. | |
| 4,622,782 | A | | 11/1986 | Roestenberg | |
| 4,697,389 | A | | 10/1987 | Romine | |
| 4,761,877 | A | | 8/1988 | Rupp | |
| 4,782,632 | A | | 11/1988 | Matechuk | |
| 4,868,949 | A | | 9/1989 | Loveless et al. | |
| 4,932,163 | A | | 6/1990 | Chilton et al. | |
| 4,932,164 | A | * | 6/1990 | Sullivan et al. | 451/359 |
| 5,033,552 | A | | 7/1991 | Hu | |
| 5,074,044 | A | | 12/1991 | Duncan et al. | |
| 5,084,972 | A | | 2/1992 | Waugh | |
| 5,105,585 | A | * | 4/1992 | Hampl et al. | 451/359 |
| 5,125,190 | A | * | 6/1992 | Buser et al. | 451/456 |
| 5,163,252 | A | * | 11/1992 | Garner et al. | 451/451 |
| 5,167,215 | A | | 12/1992 | Harding, Jr. | |
| 5,201,785 | A | | 4/1993 | Nagano | |
| 5,237,781 | A | * | 8/1993 | Demetrius | 451/456 |
| 5,327,649 | A | | 7/1994 | Skinner | |
| 5,339,571 | A | | 8/1994 | Timmons et al. | |
| 5,411,433 | A | * | 5/1995 | Keller | 451/451 |
| 5,435,066 | A | | 7/1995 | Bare et al. | |
| 5,440,809 | A | | 8/1995 | Padilla | |
| 5,545,082 | A | | 8/1996 | Courson et al. | |
| 5,558,571 | A | | 9/1996 | Toyoshima et al. | |
| 5,564,408 | A | | 10/1996 | Bassols | |
| 5,566,457 | A | | 10/1996 | Batschari et al. | |
| 5,575,035 | A | | 11/1996 | Reis et al. | |
| 5,588,213 | A | | 12/1996 | Swanberg | |
| 5,609,516 | A | | 3/1997 | Courson et al. | |
| 5,653,561 | A | | 8/1997 | May | |
| 5,675,895 | A | | 10/1997 | Mori et al. | |
| 5,688,082 | A | | 11/1997 | Richardson | |
| 5,704,956 | A | | 1/1998 | Loveless et al. | |
| 5,713,785 | A | | 2/1998 | Nishio | |
| D392,531 | S | | 3/1998 | Richardson | |
| 5,774,992 | A | | 7/1998 | Lindenmuth | |
| 5,791,979 | A | | 8/1998 | Duncan et al. | |
| 5,816,733 | A | | 10/1998 | Ishikawa et al. | |
| 5,931,072 | A | | 8/1999 | Shibata | |
| 5,954,863 | A | | 9/1999 | Loveless et al. | |
| 6,027,399 | A | * | 2/2000 | Stewart | 451/353 |
| 6,053,674 | A | | 4/2000 | Thompson | |
| 6,108,912 | A | | 8/2000 | Radigan | |
| 6,138,317 | A | | 10/2000 | Holmes et al. | |
| 6,167,626 | B1 | | 1/2001 | Doumani et al. | |
| 6,219,922 | B1 | | 4/2001 | Campbell et al. | |
| 6,318,352 | B1 | | 11/2001 | Gnazzo et al. | |
| 6,347,985 | B1 | | 2/2002 | Loveless | |
| 6,471,574 | B1 | | 10/2002 | Rupprecht et al. | |
| 6,557,261 | B1 | | 5/2003 | Buser et al. | |
| 6,648,742 | B1 | | 11/2003 | Segiel Jr. | |
| 6,699,114 | B1 | * | 3/2004 | Booeshaghi et al. | 451/451 |
| 6,726,554 | B1 | * | 4/2004 | Chen et al. | 451/397 |
| 6,748,660 | B2 | | 6/2004 | Buser et al. | |
| 6,796,208 | B1 | | 9/2004 | Jorgensen | |
| 6,811,476 | B2 | | 11/2004 | Ohlendorf | |
| 6,855,040 | B2 | | 2/2005 | Huber | |
| 6,860,799 | B2 | | 3/2005 | Loveless | |
| 6,878,050 | B2 | | 4/2005 | Wendt et al. | |
| 6,896,604 | B1 | * | 5/2005 | Taylor et al. | 451/451 |
| 6,902,594 | B2 | | 6/2005 | Cho | |
| 6,935,939 | B1 | | 8/2005 | Buser et al. | |
| 7,047,647 | B1 | | 5/2006 | Muller et al. | |
| 7,047,650 | B2 | * | 5/2006 | Chen | 30/388 |
| 7,195,429 | B2 | | 3/2007 | Dods et al. | |
| 7,197,826 | B2 | | 4/2007 | Baxivanelis et al. | |
| 7,223,161 | B2 | | 5/2007 | Kodani et al. | |
| 7,625,265 | B2 | * | 12/2009 | Woods et al. | 451/451 |
| 7,635,293 | B2 | | 12/2009 | Sun et al. | |
| 7,661,195 | B1 | | 2/2010 | Wood et al. | |
| 7,892,075 | B2 | * | 2/2011 | Esenwein | 451/451 |
| 2005/0088866 | A1 | | 4/2005 | Levine | |
| 2006/0019585 | A1 | | 1/2006 | Zayat | |
| 2007/0178815 | A1 | * | 8/2007 | Buser | 451/451 |
| 2007/0193759 | A1 | | 8/2007 | Sweig et al. | |
| 2007/0251104 | A1 | | 11/2007 | Heinrichs et al. | |
| 2008/0060631 | A1 | | 3/2008 | Dofher | |
| 2008/0099053 | A1 | | 5/2008 | Loveless | |
| 2008/0109986 | A1 | | 5/2008 | Loveless | |
| 2008/0200103 | A1 | * | 8/2008 | Esenwein | 451/455 |
| 2008/0271323 | A1 | | 11/2008 | Perlmutter | |
| 2009/0181604 | A1 | | 7/2009 | Loveless | |
| 2009/0181605 | A1 | | 7/2009 | Loveless | |
| 2009/0181606 | A1 | | 7/2009 | Loveless | |
| 2009/0183377 | A1 | | 7/2009 | Loveless | |
| 2009/0183800 | A1 | | 7/2009 | Loveless | |
| 2009/0186559 | A1 | | 7/2009 | Loveless | |
| 2009/0311953 | A1 | | 12/2009 | Maute et al. | |

FOREIGN PATENT DOCUMENTS

| | | | |
|---|---|---|---|
| EP | 0579964 | | 1/1994 |
| GB | 2 260 721 | | 4/1993 |
| GB | 2262159 | A | 6/1993 |
| JP | 10-000559 | | 1/1998 |
| JP | 10015717 | A | 1/1998 |
| JP | 2001096525 | A | 4/2001 |
| KR | 10-2002-0056086 | | 7/2002 |
| WO | WO 9944786 | A1 | 9/1999 |

* cited by examiner

DUST SHROUD WITH ADJUSTABLE MOUNTING MECHANISM

RELATED APPLICATIONS

The present application claims the benefit of U.S. Provisional Application Ser. No. 61/021,322, filed Jan. 15, 2008, which is expressly incorporated herein in its entirety.

BACKGROUND OF THE INVENTION

1. The Field of the Invention

The present invention relates to dust shrouds. More specifically, the present invention relates to a universal dust shroud for angle grinders.

2. State of the Art

Dust shrouds have become more commonly used for multiple purposes. Angle grinders, for example, are commonly used for grinding cement or other similar tasks. Without a dust shroud, debris is scattered over a wide area. It is desirable to contain the dust which is created for several reasons. It is desirable to contain the dust and debris to keep the workplace cleaner and to minimize the time necessary to clean up afterwards. Fine dust is often created while grinding cement, for example, which spreads a large distance and can be quite difficult to clean up afterwards. It is also desirable to contain the dust and debris to keep the same from getting into the tool itself, causing premature failure of the bearings, motor, etc. Additionally, debris such as concrete dust poses a health risk to the machine operator and others who may breathe it. It is thus desirable to collect the dust to minimize any exposure to the dust.

One difficulty in providing dust shrouds is the fact that each particular tool will have different mounting requirements. For angle grinders, each grinder will typically have a collar which is concentric to the output shaft which may be used to mount a dust shroud. For each grinder, however, the collar may be a different diameter and may be a different height from the grinding disk. As such, the dust shroud must accommodate the particular mounting diameter and height of the desired tool. Another difficulty in providing dust shrouds is in providing a dust shroud which does not overly interfere with the use of the grinder itself.

It is thus appreciated that the requirements for a dust shroud varies according to the particular angle grinder with which the dust shroud is being used. Many stores, however, do not wish to stock many different models of dust shrouds. It is similarly not desirable for a manufacturer to make many different models of dust shrouds, as it increases the tooling and production costs. Individual consumers do not wish to special order a dust shroud and wait for weeks for it to arrive. There is thus a need for universal dust shrouds which allow a single shroud to be used with many different brands of tools while still performing properly. Such a universal dust shroud should safely and securely mount to a wide variety of angle grinders while effectively collecting dust and debris and without interfering with the use of the angle grinder.

SUMMARY OF THE INVENTION

It is an object of the present invention to provide an improved universal dust shroud.

According to one aspect of the invention, a dust shroud is provided which is adjustable to fit varying diameters of mounting collars on different tools. The mounting brackets which attach to the collar are movable inwardly or outwardly to accommodate different tool sizes.

According to another aspect of the invention, the distance between the mounting brackets and the shroud body is adjustable to properly position the shroud around the grinding disk.

According to another aspect of the invention, the shroud body is vertically movable relative to the mounting brackets during use so as to allow the operator to contact a surface with the grinding disk as desired.

These and other aspects of the present invention are realized in a universal dust shield as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
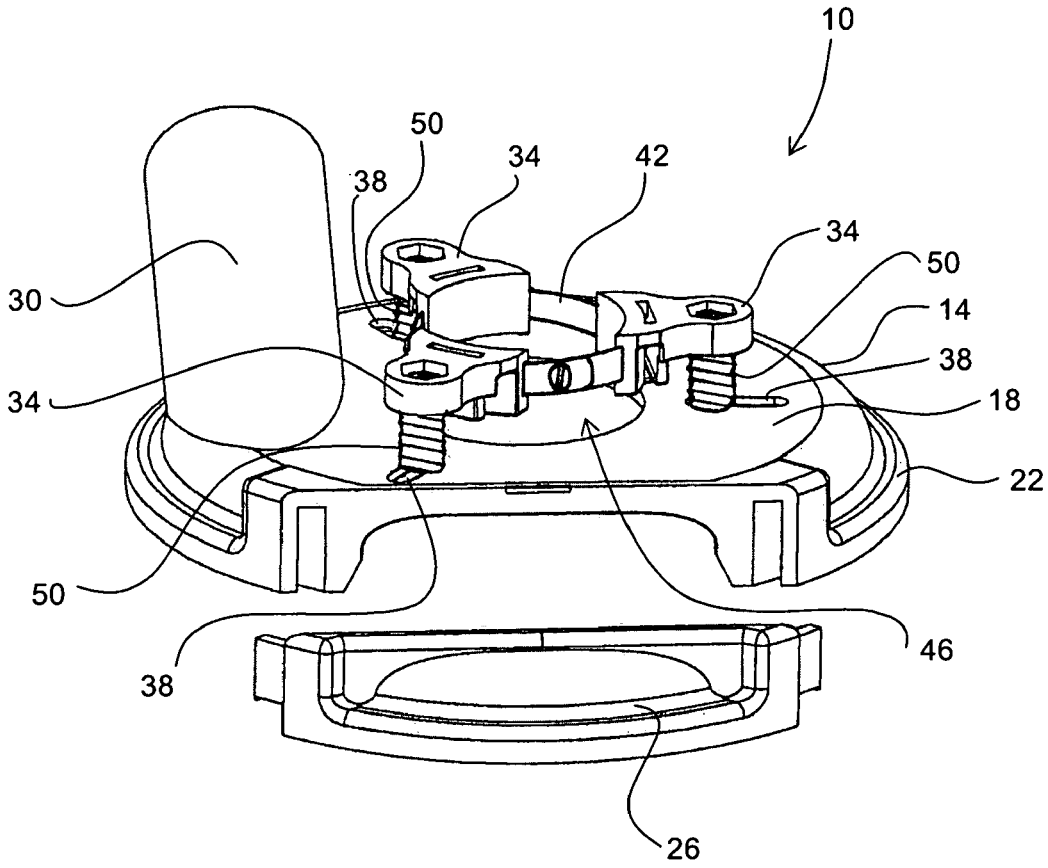
FIG. 1 shows a perspective view of a shroud according to the present invention.

Turning now to FIG. 1, a perspective view of a shroud 10 is shown. The shroud 10 is designed for use with an angle grinder. The shroud includes a body 14 which has a generally flat top 18 and a skirt 22 which will enclose the top and sides of a grinding disk. The body 14 may include a removable hatch 26 which exposes a side of the grinding disk for grinding into a corner, such as grinding a floor against a wall. A vacuum port 30 is used to connect a conventional 1.25 inch vacuum hose (although other sizes of hoses could be used) to the shroud to capture the dust created while grinding.

In order to accommodate a variety of different angle grinders with a single shroud 10, the shroud includes three mounting brackets 34 which are attached to the body 14. The mounting brackets 34 are attached to the body 14 via slots 38, and can slide inwardly and outwardly to adjust the space between the mounting brackets. A worm drive hose clamp 42 is held in slots in the brackets 34 and is used to securely fasten the brackets to an angle grinder so that the output shaft of the angle grinder passes through the hole 46.

The brackets are typically attached to the body 14 by bolts which pass through the slots 38 and springs 50 and are secured to the brackets 34. While the present invention describes the use of springs 50, it will be appreciated that many biasing elements such as a resilient foam or elastomeric tubing such as vinyl, silicone, or latex tubing will provide the desired amount of flexibility and movement. Thus, although described primarily as springs 50, the biasing element 50 may be a flexible tube or piece of foam and such is intended to be included in the definition of biasing elements or springs as used herein. The springs 50 allow some compression between the brackets 34 and the body 14, allowing the operator flexibility in choosing which part of the grinding disk contacts the work surface and in choosing how much pressure to apply while grinding.

Figure 2:
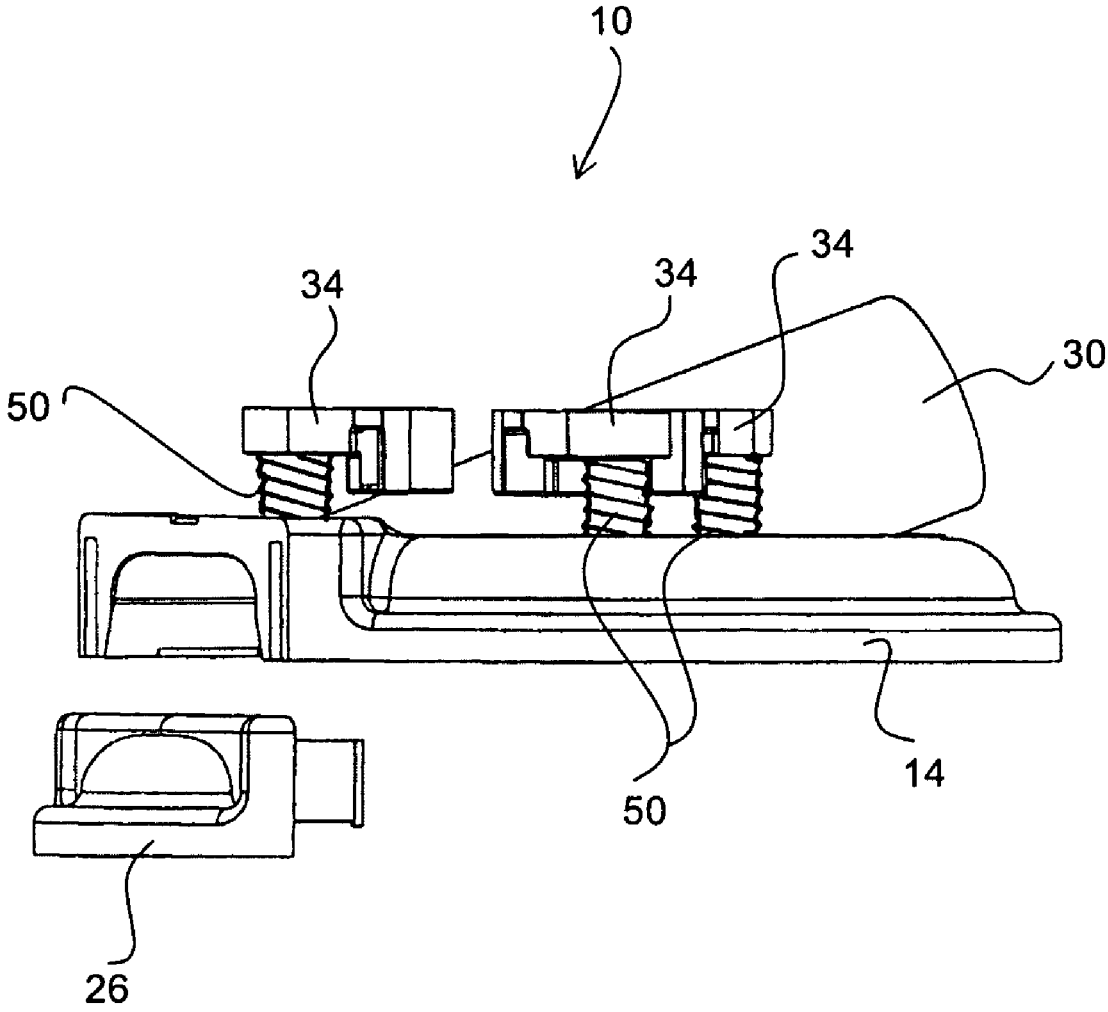
FIG. 2 shows a side view of the shroud of FIG. 1.

Turning now to FIG. 2, a side view of the shroud 10 is shown. The clamp 42 is omitted for clarity. It can be seen how the brackets 34 float above the body 14, and how compression of the springs 50 allow for movement there between.

Figure 3:
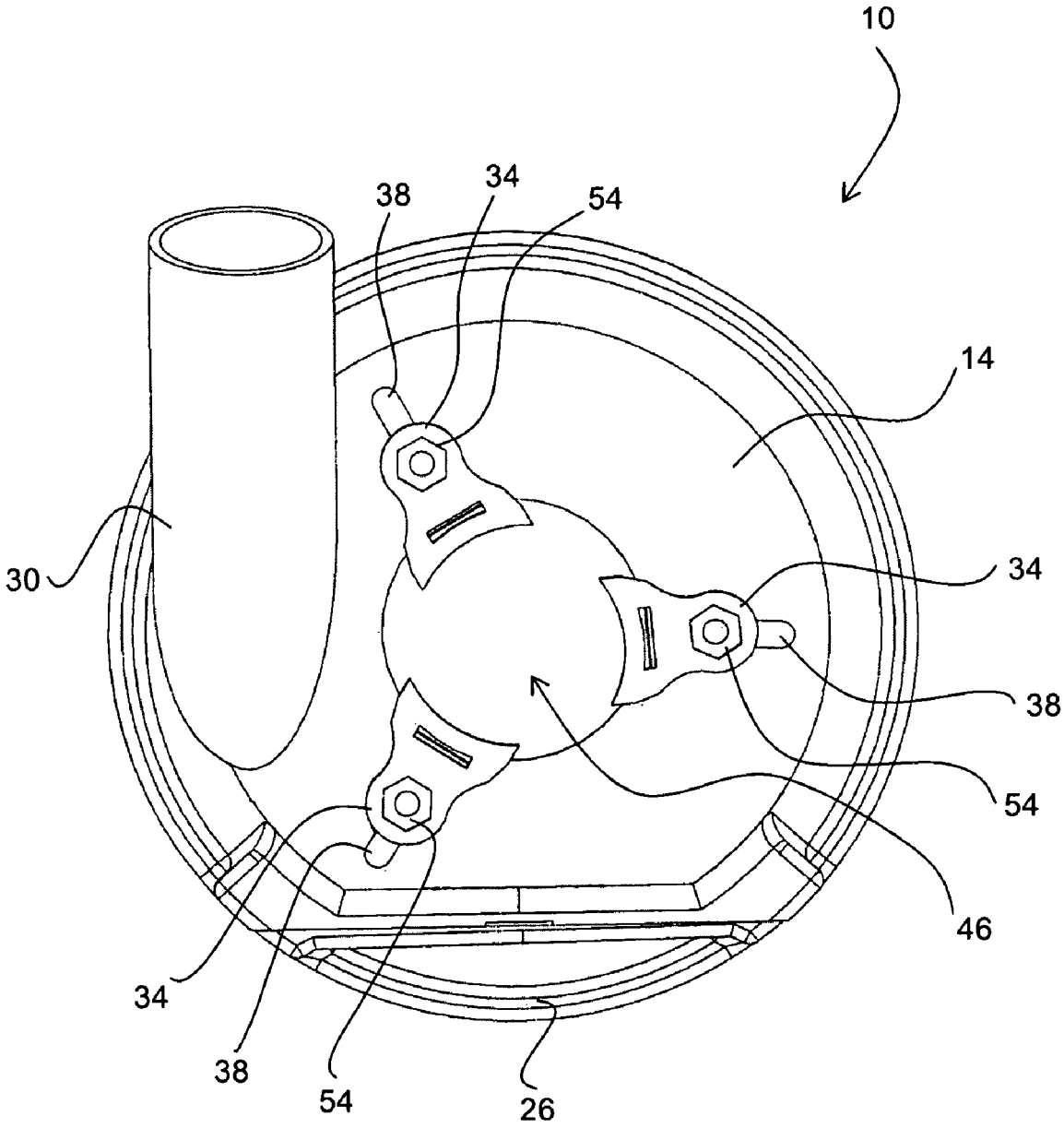
FIG. 3 shows a top view of the shroud of FIG. 1.

Turning now to FIG. 3, a top view of the shroud 10 is shown with the clamp 42 omitted. The brackets 34 may be formed with a hexagonally shaped recess 54 on the top to receive a nut, such as a nylon lock nut. The bolt which connects the brackets 34 to the body will pass through the body 14, through the bracket, and thread into the nut. It will be appreciated that the bolt may thread directly into the brackets 34, but using a nut will help prevent damage to the bracket and will allow for replacement of the engaging threads if they become damaged.

Figure 4:
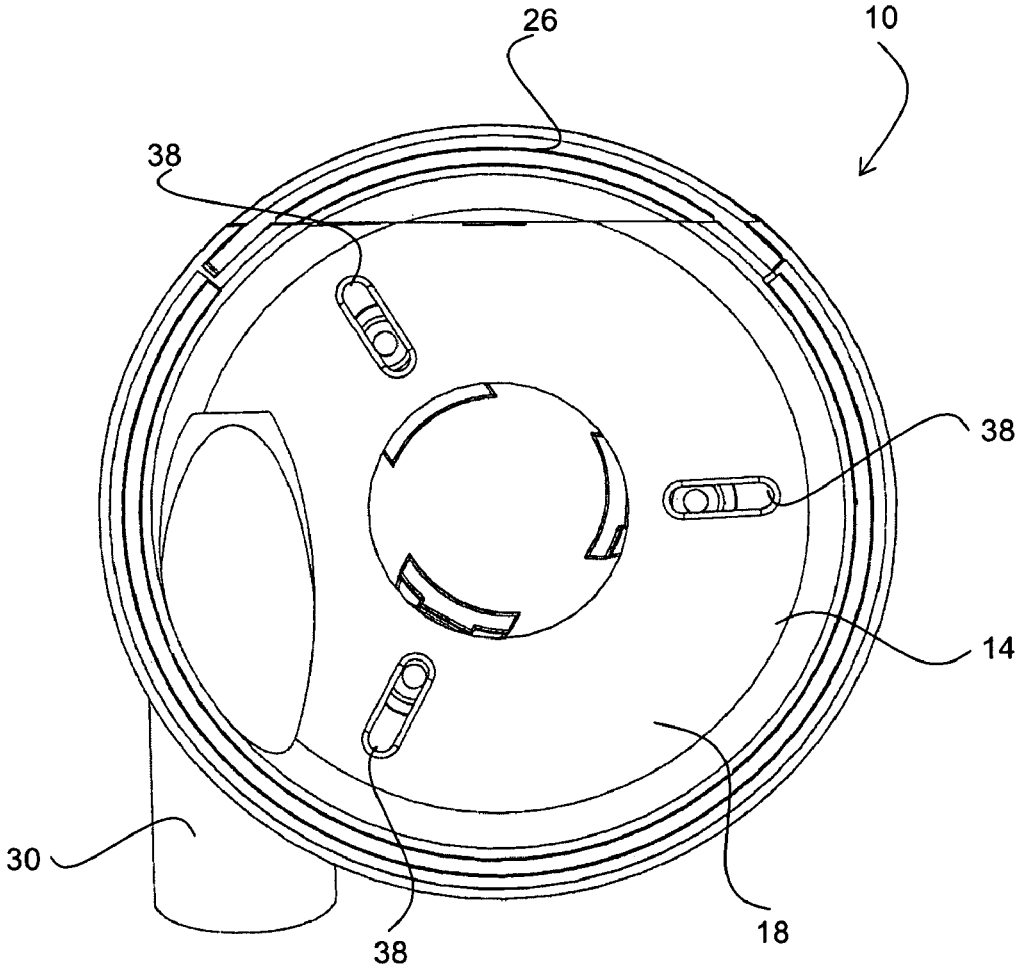
FIG. 4 shows a bottom view of the shroud of FIG. 1.

Turning now to FIG. 4, a bottom view of the shroud 10 is shown. The slots 38 are better seen. The slots 38 may have beveled edges on the bottom side so as to allow a flat-head bolt to fit flush with the underside of the body 14. Although the bolts are omitted for clarity, they would pass through the slots 38 so that the head of the bolt is adjacent the top 18 of the body 14. It can be seen how the vacuum port 30 is open to the space which is enclosed by the body 14 so as to collect the dust created by a grinding disk.

Figure 5:
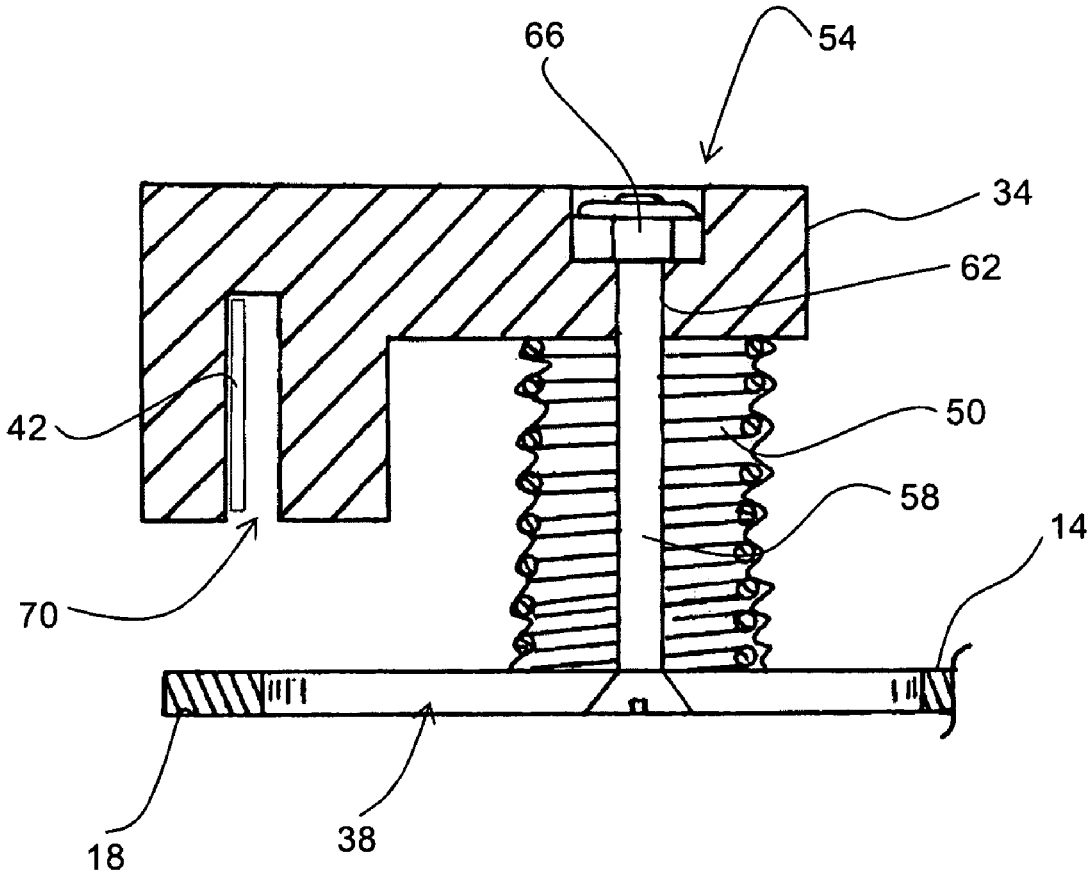
FIG. 5 shows a partial cross-sectional view of the shroud of FIG. 1.

Turning now to FIG. 5, partial cross-sectional view of a bracket 34 and body 14 is shown. A single bracket 34 is shown, and the portion of the body 14 near the slot 38 is shown. The bracket 34, body 14, and spring 50 are shown in cross section. A bolt 58, preferably a flat head bolt, is used to attach the bracket 34 to the body 14. The bolt 58 passes through the slot 38, the spring 50, a hole 62 in the bracket 34, and is secured to a lock nut 66. The lock nut 66 is placed in the hexagon shaped recess 54. It can be seen how tightening the bolt 58 will move the bracket 34 closer to the body 14 and allow a user to adjust the position of the shroud as mounted to a grinder. The bolt 58 can move back and forth laterally in the slot 38, allowing the size of the opening between brackets 34 to be adjusted. In this manner, the shroud 10 will fit many different angle grinders. Thus, a single shroud may fit virtually any angle grinders which use a particular size of grinding disk.

While described primarily as a bolt 58 and nut 66, the brackets 34 may be attached to the body 14 with other fasteners such as a metal pin or the like. Bolts 58 and nuts 66 are preferable as they are adjustable in length and commonly available. Thus, if the bolts 58 or nuts 66 become damaged or worn they may be easily replaced. The length of the bolt 58 extending from the nut 66 may be easily adjusted to adjust the height of the brackets 34 relative to the body 14, allowing a user to better fit the shroud to a particular angle grinder or to a particular grinding disk or pad which is taller or thinner.

In use, the shroud body 14 will often extend slightly below a grinding disk and the user will press on the shroud in order to press the grinding disk into the work surface. The springs 50 allow the shroud to move upwardly relative to the grinding disk and allow a grinding disk to be pressed against the work surface while keeping the shroud body 14 against the work surface to collect the dust and debris. Thus, the user may set the resting position of the shroud 10 relative to the angle grinder so that the shroud extends around the grinding disk and encloses it. While using the grinder, the user would press the grinder downwardly towards a surface, typically causing the shroud 10 to first contact the surface, causing one or more of the springs 50 to compress to thereby allow the shroud to move upwardly relative to the angle grinder and grinding disk, and allowing the grinding disk to contact the work surface as desired.

The bracket 34 has a slot 70 which receives the clamp 42. When the brackets 34 are not fastened to an angle grinder via clamp 42, the brackets 34 are able to move back and forth in the slots 38 to adjust to the size of the opening between the brackets 34. The opening is adjusted to find a desired angle grinder, and the angle grinder is placed into the opening. The clamp 42 is then tightened to hold the brackets 34 securely against the angle grinder. The arrangement of the slots 38 prevent movement of the body 14 relative to the brackets 34 once the shroud 10 is installed on the angle grinder, preventing accidental contact between the shroud body 14 and a grinding disk.

The shroud 10 is significantly easier to install than available universal dust shrouds and fits a greater range of sizes of angle grinders. Other designs require the operator to tighten multiple band clamps and screws to attach the shroud to a grinder where the present shroud only requires the user to tighten a single band clamp 42. Additionally, the shroud provides increased adjustability in mounting the shroud to the angle grinder, and allows the mounted shroud skirt to move relative to the grinding disk while the grinder is in use, allowing the operator greater flexibility in using the grinder while still properly collecting the dust and debris generated by the grinder.

There is thus disclosed an improved universal dust shroud. It will be appreciated that numerous changes may be made to the present invention without departing from the scope of the claims.

What is claimed is:

1. A dust shroud for an angle grinder comprising:

a body which encloses the top and sides of a grinding disk, and a plurality of brackets, each of the plurality of brackets being attached to the body so as to be disposed above the body and so as to allow independent vertical movement of each of the brackets relative to the body, the brackets being attachable to an angle grinder so as to attach the shroud to the angle grinder so as to place the body around the grinding disk.

2. The dust shroud of claim 1, further comprising a compressible biasing element disposed between each bracket and the body.

3. The dust shroud of claim 2, wherein the compressible biasing element is a spring.

4. The dust shroud of claim 2, wherein the compressible biasing element is a piece of flexible tubing.

5. The dust shroud of claim 2, wherein each bracket is connected to the body by an attachment member which passes through the body, compressible biasing element, and bracket.

6. The dust shroud of claim 5, wherein the attachment member is a bolt.

7. The dust shroud of claim 5, wherein the attachment member and compressible biasing element allow for vertical movement of the bracket relative to the body.

8. The dust shroud of claim 1, further comprising a clamp configured for securing the brackets around the output shaft of an angle grinder.

9. The dust shroud of claim 8, wherein each of the brackets has a slot formed therein for receiving the clamp.

10. The dust shroud of claim 9, wherein the clamp is a band clamp.

11. A dust shroud for use with an angle grinder comprising:

a shroud body having an upper surface and a skirt extending downwardly therefrom so as to generally enclose a grinding disk, the upper surface having an opening formed in the center thereof for allowing the shaft of an angle grinder to pass therethrough, the shroud extending horizontally from a central axis;

a vacuum port attached to the shroud body, the vacuum port being in fluid communication with the interior of the shroud body; and a plurality of brackets resiliently attached to the shroud body around said shroud body opening and extending upwardly therefrom, the plurality of brackets being attachable to an angle grinder to secure the dust shroud to the angle grinder, and wherein the plurality of brackets are movable in a direction perpendicular from said central axis so as to adjust the distance between the plurality of brackets and wherein the plurality of brackets are individually movable in a direction parallel to the central axis so as to adjust the distance between the shroud body and the plurality of brackets.

12. The shroud of claim 11, wherein the plurality of brackets are biased away from the shroud body along said direction parallel to said central axis.

13. The shroud of claim 11, wherein the shroud body comprises slots formed therein, and wherein each of the plurality of brackets is mounted in a slot and is movable along said slot to adjust the distance between the plurality of brackets.

14. The shroud of claim 11, wherein each of the plurality of brackets is mounted to a slot via a bolt passing through the slot, through a biasing element, and through the bracket.

15. The shroud of claim 11, further comprising a clamp passing through the plurality of brackets and configured for securing the plurality of brackets to an angle grinder.

16. A dust shroud for an angle grinder, comprising:

a plurality of brackets attachable to an angle grinder;

a shroud body having an upper surface and a skirt extending therefrom so as to generally enclose a grinding disk;

a vacuum port attached to the shroud body and being in fluid communication with a cavity defined by the shroud body; and wherein the plurality of brackets are resiliently attached to the shroud body so as to permit vertical movement of the shroud body relative to the plurality of brackets.

17. The shroud of claim 16, wherein the shroud body has slots formed therethrough, and wherein the plurality of brackets are each mounted to a slot to allow for adjustment of the space between the plurality of brackets to accommodate differing sizes of angle grinders.

18. The shroud of claim 16, wherein each of the plurality of brackets further comprises a bolt which passes through the shroud body, through a spring, and through the bracket such that the spring biases the bracket away from the shroud body, the bolt limits the movement of the bracket away from the shroud body, and the bracket may be moved towards the shroud body against the bias of the bolt.

19. The shroud of claim 18, wherein the bolt may be adjusted to vary the maximum distance between the bracket and the shroud body.

* * * * *